US010687648B1

(12) United States Patent
Lowe

(10) Patent No.: US 10,687,648 B1
(45) Date of Patent: Jun. 23, 2020

(54) MESSAGE ORNAMENT APPARATUS AND METHOD OF USE

(71) Applicant: Perine Lowe, Inc., Brea, CA (US)

(72) Inventor: Patrice Lowe, Brea, CA (US)

(73) Assignee: Perine Lowe, Inc., Brea, CA (US)

( * ) Notice: Subject to any disclaimer, the term of this patent is extended or adjusted under 35 U.S.C. 154(b) by 356 days.

(21) Appl. No.: 15/693,192

(22) Filed: Aug. 31, 2017

(51) Int. Cl.
*A47G 33/08* (2006.01)
*A47G 33/10* (2006.01)

(52) U.S. Cl.
CPC ..... *A47G 33/08* (2013.01); *A47G 33/10* (2013.01)

(58) Field of Classification Search
CPC ..... A47G 33/08; A47G 33/10
USPC ..... 428/11
See application file for complete search history.

(56) References Cited

U.S. PATENT DOCUMENTS 4,358,013 A * 11/1982 Shebley ..... A47G 33/00 206/232
5,934,785 A * 8/1999 Chen ..... A47G 33/08 362/124
6,217,956 B1 * 4/2001 Heidkamp ..... A47G 33/08 283/110
6,399,167 B1 * 6/2002 Lewis, Jr. ..... A47G 33/08 428/11
7,430,823 B1 * 10/2008 Chung ..... G09F 19/02 40/409
9,204,748 B2 * 12/2015 Loomis ..... F21V 21/088
2003/0182963 A1 * 10/2003 Beatty ..... A44C 15/003 63/1.14
2003/0195766 A1 * 10/2003 Abramson ..... A47G 33/08 705/329
2005/0045514 A1 * 3/2005 Knotts ..... A47G 33/08 206/457
2016/0015201 A1 * 1/2016 Morales ..... A47G 33/08 428/16
2018/0199746 A1 * 7/2018 Lin ..... A47G 33/08

OTHER PUBLICATIONS

Wurm, M.; "Inspired by Charm: Holiday Gifting with Clear Glass Ornaments", https://inspiredbycharm.com/holiday-gifting-with-clear-glass-ornaments/; 2016; p. 27-29 (Year: 2016).*
Pleasure in simple things blog page content entitled "message in a bottle ornament diy" obtained Aug. 24, 2017 from http://www.pleasureinsimplethings.com/message-in-a-bottle-ornament-diy/.

(Continued)

*Primary Examiner* — Mark Ruthkosky
*Assistant Examiner* — Julia L Rummel
(74) *Attorney, Agent, or Firm* — Lodestone Legal Group; Jeromye V. Sartain

(57) ABSTRACT

A message ornament apparatus comprising an at least partially transparent and at least partially hollow ornament body having a fixed opening, an ornament decoration disposed within the ornament body, a user-written message scroll configured for selective insertion within the ornament body through the opening, and a message holder configured for installation within the ornament body to facilitate selective securement or removal of the message scroll through the opening without removing the ornament decoration.

13 Claims, 5 Drawing Sheets

(56) References Cited

OTHER PUBLICATIONS

Etsy—LizzieJoeDesigns web page content entitled "Message in a Bottle Ornament—Flat Oval—Wedding Christmas Holiday Gift Home Decor" obtained Aug. 24, 2017 from https://www.etsy.com/listing/159768710/message-in-a-bottle-ornament-flat-oval.
Etsy—shoppe3130 web page content entitled "Adoption Glass Ornament You choose the verse or message and place" obtained Aug. 24, 2017 from https://www.etsy.com/listing/87659119/adoption-glass-ornament-you-choose-the?ref=v1_other_1.
Etsy—thecraftspottoshop web page content entitled "Angel Feather Memory Ornament" obtained Aug. 24, 2017 from https://www.etsy.com/listing/63344840/angel-feather-memory-ornament?ref=unav_listing-other-21.
Etsy—FlutterByFolly web page content entitled "Glass Christmas Ornament" obtained Aug. 24, 2017 from https://www.etsy.com/listing/482447180/glass-christmas-ornament?ref=unav_listing-other.
Pepper & buttons blog page content entitled "Personalised Glass Baubles :: Monogram" obtained Aug. 24, 2017 from http://pepperbuttons.blogspot.com/2011/11/on-sale-now-at-our-etsy-store.html.
Pinterest web page content entitled "Explore Handmade Ornaments, Gender Reveal, and more!" obtained Aug. 24, 2017 from https://www.pinterest.com/pin/331788697533291730/.
Harriet Carter web page content entitled "Gift Box Ornaments" obtained Aug. 24, 2017 from https://www.harrietcarter.com/products/gift-box-ornaments-9430-1.

* cited by examiner

MESSAGE ORNAMENT APPARATUS AND METHOD OF USE

BACKGROUND

The subject of this patent application relates generally to decorative or novelty ornaments, and more particularly to ornaments configured for selective insertion and removal of scrolled messages.

The following description includes information that may be useful in understanding the present invention. It is not an admission that any of the information provided herein is prior art or relevant to the presently claimed invention, or that any publication specifically or implicitly referenced is prior art.

Applicant(s) hereby incorporate herein by reference any and all patents and published patent applications cited or referred to in this application, to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

By way of background, customized or personalized gifts or novelty items abound in the marketplace. It is often desirable to purchase or give such a gift or novelty item at least, for example, bearing a person's name or initials, again whether as pre-produced or somehow customized or personalized as part of the purchase, as by printing, engraving, laser etching, silk screening, embroidering, or any other such technique. Such gifts may be further customized or personalized with a message in the same manner, such as to commemorate a special event by date and description or to provide a meaningful, unique inscription.

Regarding Christmas and other holiday-themed gifts or novelty items, customization or personalization is again often desired to mark such occasions for the gift giver and the recipient, in connection with items ranging from stockings to ornaments to various other decorations. Even in the specific case of tree ornaments or other hanging ornaments and the like, it is often desirable to customize or personalize such an ornament on its surface or, in the case of transparent or translucent, hollow ornaments to even place personal, meaningful messages or mementos inside the ornament, thus again customizing the ornament to the user's liking.

Whether such tree or hanging, decorative ornaments are spherical or "ball-shaped" or any other shape, where they are hollow, they typically have a small, round opening at the top defined by an annular wall that extends from the main body of the ornament, the opening serving as the only means of accessing the interior of the ornament and most often being covered or plugged with a cap having a circular body with perimeter skirt configured to go about and cover the annular wall defining the mouth or opening of the ornament and further having incorporated therein a flexible wire with two legs that protrude downwardly from the cap and are biased outwardly so as to selectively be squeezed inwardly to pass through the opening and then spring outwardly against the inside surface of the ornament to secure the cap in place over the opening on or about the annular opening wall. Further, the legs may be formed of a single wire that is bent as desired and so further defines a ring that extends upwardly from the cap by which the ornament may be hung as by a hook, ribbon, string, twine, chain, etc. Alternatively, such ornament opening may be plugged with a cork or other component, in any case such component typically having a ring or other feature, again, by which the ornament may be hung. Where such a decorative tree or hanging ornament is hollow, once more, it may be further desired to have the walls of the ornament be transparent or translucent, in whole or in part, so that the contents of the ornament are visible.

In connection with any such tree or hanging, decorative ornaments that are hollow and to some extent clear for viewing any contents therein, it will be appreciated that practical challenges relate to placing any items within the ornament and, should it ever be desired to change or remove such items, getting them back out of the ornament. Relatedly, it will be appreciated that the passage of any items into and out of such an ornament is effectively limited by the size of the opening formed in the body. And as it is often the case that an item may be insertable or pass through the opening in only one orientation, even items that were able to be inserted may then not be readily removed. Removal of decorations or mementos or particularly personalized messages may be desired to customize the ornament for a particular occasion or recipient, hence the need to conveniently insert or remove such messages and the like, which again is not readily achieved with typical decorative ornaments of various kinds. Other approaches to this problem involve forming the ornament itself, or its body, in two halves that can be selectively separated so as to access the interior, but the disadvantages of such a two-half design relate to both the cost of the ornament and, more significantly, the appearance of the ornament, with such a seam along which the two halves are joined obscuring part of the interior and contents and generally being aesthetically displeasing. Moreover, opening the ornament up as in a clamshell design or manipulating the ornament as by turning it upside down in an attempt to remove a message scroll may result in the unwanted removal of at least a portion of any decorations found within the ornament. Of course, personalized messages and mementos can in theory be placed within an ornament at the manufacturing stage such that the body of the ornament is continuous as desired for aesthetics, but this is to no avail for end users wishing to customize or personalize and even periodically change the contents of an ornament.

Thus, what has been needed and has heretofore been unavailable is a tree or hanging, decorative ornament that has a continuous body other than the opening and yet is configured for conveniently allowing the insertion and removal of personalized messages and mementos through the opening without unwanted removal of other decorations.

Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing a message ornament apparatus and method of use. In at least one embodiment, the message ornament apparatus comprises: an at least partially transparent and at least partially hollow ornament body having a fixed opening; an ornament decoration disposed within the ornament body; a user-written message scroll configured for selective insertion within the ornament body through the opening; and a message holder configured for installation within the ornament body to facilitate selective securement or removal of the message scroll through the opening without removing the ornament decoration.

Other objects, features, and advantages of aspects of the present invention will become more apparent from the following detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Figure 1:
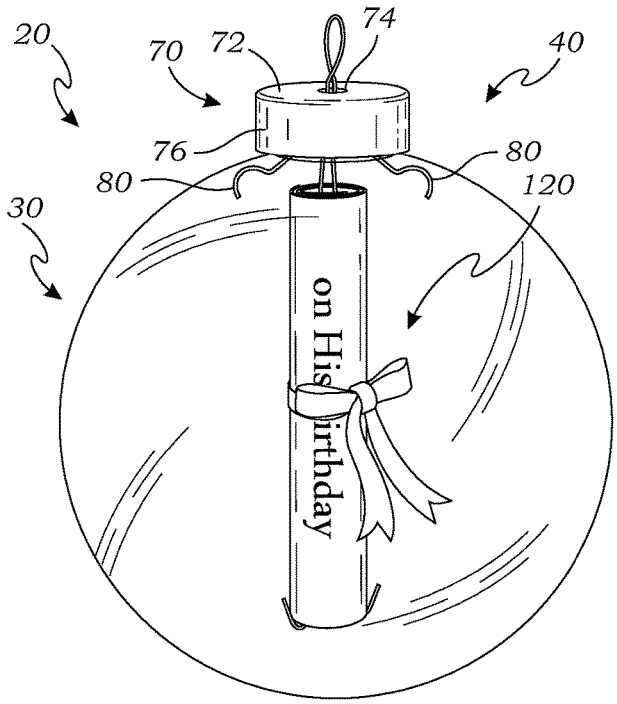
FIG. 1 is a perspective view of an exemplary message ornament apparatus, in accordance with at least one embodiment.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments. More generally, those skilled in the art will appreciate that the drawings are schematic in nature and are not to be taken literally or to scale in terms of material configurations, sizes, thicknesses, and other attributes of an apparatus according to aspects of the present invention and its components or features unless specifically set forth herein.

DETAILED DESCRIPTION

The following discussion provides many exemplary embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

While the inventive subject matter is susceptible of various modifications and alternative embodiments, certain illustrated embodiments thereof are shown in the drawings and will be described below in detail. It should be understood, however, that there is no intention to limit the invention to any specific form disclosed, but on the contrary, the inventive subject matter is to cover all modifications, alternative embodiments, and equivalents falling within the scope of the claims.

Referring first to FIG. 1, there is shown a perspective view of an exemplary embodiment of a message ornament apparatus 20 according to aspects of the present invention. The apparatus 20 comprises, in the exemplary embodiment, an ornament body 30 and a message holder 40 selectively and operably engaged with the ornament body 30. In the exemplary embodiments, the ornament body 30 is shown as being substantially spherical, though it will be appreciated that the body 30 can take virtually any shape, such that the exemplary spherical body 30 is to be understood as merely illustrative of aspects of the invention and non-limiting. As also illustrated, the ornament body 30 is substantially clear or transparent substantially throughout such that any objects within the body 30 are visible from outside the body 30, essentially from all sides or directions, though it will again be appreciated that such substantially complete transparency of the body 30 is illustrative and not required. In alternative embodiments only one or more portions of the body 30 may be substantially clear or transparent and/or all or part of the body 30 may be translucent or opaque. The ornament body 30 may optionally be frosted, painted, decorated on the outside/inside surfaces, etc. Again, any combinations of such features or attributes of the message ornament body 30 are possible according to aspects of the present invention without departing from the spirit and scope of the invention. The body 30 may be formed of any suitable material and by any suitable manufacturing method now known or later developed, including but not limited to molded or blown glass or plastic of any color or thickness. As to color specifically, those skilled in the art will appreciate that the ornament body 30 may be tinted or have a hue rather than being perfectly clear while still being effectively transparent, or allowing for visibility of any items within the message ornament body 30. Though not shown, the outer and/or inner surface(s) of the body 30 may again have decorations, artwork, designs, or the like, in whole or in part, applied to or formed on or in the body as through any suitable process now known or later developed, including but not limited to molding, machining, etching, engraving, painting, silk-screening, marking, bonding, adhering, as with appliques or decals, or the like. Again, dimensionally, the message ornament body 30 can be of any thickness based on a number of factors, including but not limited to the material and manufacturing method, while its overall size in terms of width, height, or diameter may also vary widely, though it being appreciated that such ornaments as may be decoratively hung on a tree or in some other manner, in the case of being substantially round or spherical, are typically on the order of two to four inches (2-4 in.) in diameter, though may also be smaller or larger. Once more, it will be appreciated by those skilled in the art that the present message ornament invention is not in any way limited to such size and configuration variations, all of which are merely illustrative of features and aspects of the invention and encompassed within its spirit and scope.

Figure 2:
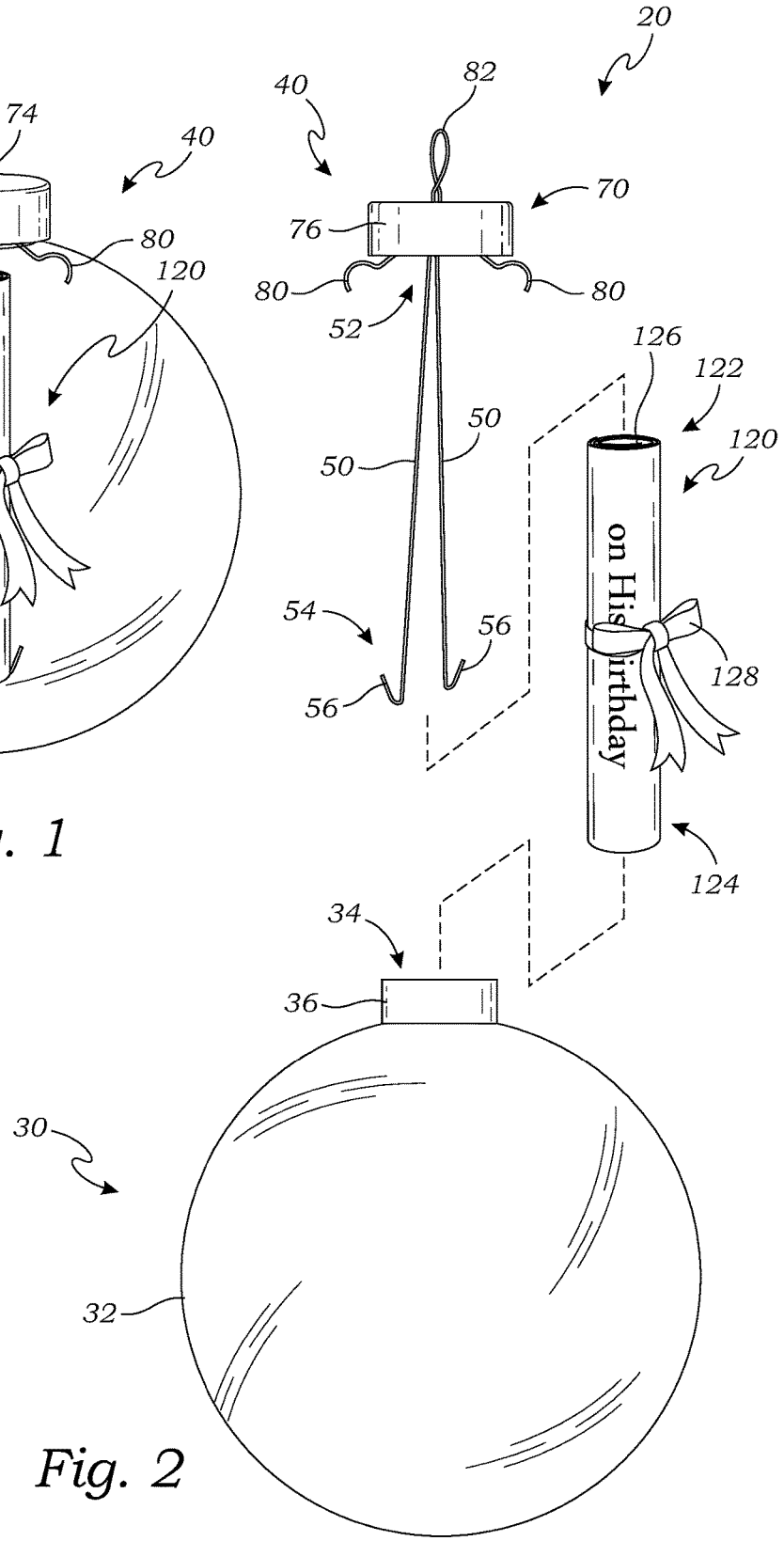
FIG. 2 is an exploded side view thereof, in accordance with at least one embodiment.

With continued reference to FIG. 1 and now with further reference to the exploded side view of FIG. 2, it can be seen that the exemplary message ornament apparatus 20 again generally comprises an ornament body 30 and a message holder 40 selectively and operably engaged with the ornament body 30. As a threshold matter, there is shown as being employed with the apparatus 20 a message 120 that is rolled up as a scroll and bound by a ribbon 128, though it will be appreciated by those skilled in the art that the message 120 need not be so configured or bound. More generally, any such message 120 may be included with the message ornament apparatus 20, in one or more copies and/or forms, as in a kit or packaged product, though it will be appreciated that the apparatus 20 need not include such message scrolls 120 or the like, which may instead be sold or supplied separately or simply created as desired by an end user to be employed in conjunction with the message ornament apparatus 20. Accordingly, those skilled in the art will appreciate that the message ornament apparatus 20 as disclosed and claimed herein may or may not include a message 120 in scroll form or otherwise, and where such message 120 is not included the apparatus 20 is otherwise configured for use therewith. In any event, such message scroll 120 may be pre-printed, in whole or in part, with user-written content added to the message scroll 120 as by hand-writing, printing, or the like. With the contemplated message 120 formed or rolled up as a scroll or otherwise configured to be somewhat tubular as inserted within the ornament body 30, as best seen in FIG. 2, the message holder 40 is in the exemplary embodiment configured as a pair of offset, somewhat downwardly-projecting and outwardly biased legs 50 formed so as to extend through not only the opening 34 formed in the wall 32 of the ornament body 30 but also through the central core 126 of the message scroll 120. More particularly, the exemplary legs 50 are formed of sufficient length so as to extend axially all the way through the message scroll 120 from one end to the other, or to be inserted into the core 126 at the proximal end 122 of the message scroll 120 and extend beyond the opposite distal end 124 thereof, the legs 50 being further formed at their free distal ends 54 with somewhat radially outwardly-projecting tines 56 configured to hook beneath the distal end 124 of the message scroll 120 and thereby support and retain the message scroll 120 on the message holder 40. Those skilled in the art will appreciate that such holder legs 50 and any related tines 56 may be formed in a number of other configurations in selectively and temporarily supporting or retaining a message 120 beyond those shown and described, such that the exemplary message holder 40 is to be understood as illustrative of aspects of the present invention and non-limiting. As also shown, the message holder 40, here again configured as downwardly-projecting and outwardly biased legs 50, may be installed on, formed integrally with, or otherwise incorporated into the ornament cap 70, as by forming or joining the proximal ends 52 with the structure of the cap 70, employing any appropriate manufacturing and assembly technique(s) now know or later developed, including but not limited to molding, forming, stamping, machining, bonding, welding, fastening, and the like, or in other embodiments the legs 50 may be independent of the cap 70. In the exemplary embodiment, the holder 40 and the legs 50 specifically are formed so as to extend substantially vertically and centrally from the top 72 of the cap 70. It will be appreciated with continued reference to FIGS. 1 and 2 and further reference to the partially exploded side view of FIG. 3 that in use the substantially central location of the holder 40 relative to the cap 70 facilitates substantially central retention of the message scroll 120 on the holder 40 beneath the cap 70 and thus passage of the holder 40 and message scroll 120 through the opening 34 formed in the ornament body 30 as the cap 70 is secured over the opening 34. In a bit more detail, the exemplary ornament body 30 is formed with a radially- or proximally-extending neck 36 about and effectively defining the opening 34, and the ornament cap 70 is formed about the perimeter of its top 72 with a distally-extending wall or skirt 76 sized and configured to slide over and about the neck 36 as the cap top 72 abuts the neck 36. Furthermore, as is known in the art, the cap 70 may be formed with outwardly-biased arms 80 configured to selectively contact the inner surface of the ornament body 30 so as to retain the cap 70 thereon. Oftentimes such arms 80 are formed from a continuous piece of resilient wire bent or shaped to define both the opposing arms 80 and even a ring 82 for selectively hanging the assembled message ornament apparatus 20 as through a hook, ribbon, string, twine, chain, etc. (not shown), such ring 82 extending upwardly or proximally through a hole 74 formed in the cap top 72. Alternatively, the arms 80 and ring 82 may be formed separately, in either case optionally also being separate from or integral with the cap 70. Further optionally, the opposite legs 50 may be formed of a similar resilient wire bent or shaped as desired to bias the distal ends 54 thereof outwardly independent of or integral with one or more of the arms 80 and ring 82 of the cap 70. Those skilled in the art will appreciate that a variety of configurations and arrangements of such components beyond those shown and described are possible without departing from the spirit and scope of the invention. In use, it will be appreciated that first in loading the message scroll 120 onto the holder 40, the distal ends 54 of the legs 50 may be squeezed together so that the legs 50, and the tines 56 specifically, may be inserted into the core 126 of the message scroll 120. The tines 56 would simply slide along the inner surface of the scroll core 126 as the holder 40 is shifted distally relative to the message scroll 120 until the tines 56 are clear of the distal end 124 of the message scroll 120, at which point the outwardly-biased legs 50 would shift outwardly, thereby positioning the tines 56 beneath the distal end 124 of the message scroll 120 and thus securing the message scroll 120 on the holder 40. The message holder 40 in combination with the cap 70 as now retaining the message scroll 120 may then simply be inserted vertically through the opening 34 in the wall 32 until the cap 70 is seated on the neck 36 with the holder 40 and thus the message scroll 120 contained within the ornament body 30 to complete assembly of the message ornament apparatus 20. Particularly, it will be appreciated that in seating and securing the cap 70, the arms 80 may simply be squeezed inwardly as they pass into the opening 34 of the neck 36, whereby further distal movement of the cap 70 relative to the ornament body 30 until the top 72 of the cap 70 somewhat abuts the neck 36 allows the arms 80 to again shift outwardly and thus contact the inner surface of the wall 32 of the body 30 to thereby retain the cap 70 thereon, again in a manner known in the art. To remove and replace the message scroll 120, the foregoing steps may simply be repeated, first in reverse as by pulling the cap 70 off of the ornament body 30 as by shifting it distally therefrom until the holder 40 and retained message scroll 120 are passed completely through the opening 34 and are thus free of the ornament body 30 once again. The tines 56 at the distal ends 54 of the legs 50 may then be squeezed together to allow the message scroll 120 to be slid axially and distally off of the holder 40. A new message 120 may then be placed on the holder 40 and inserted into the ornament body 30 as above-described, and so on. Accordingly, those skilled in the art will appreciate that according to aspects of the present message ornament apparatus 20 invention, a customized or personalized message scroll 120 may be easily inserted into and removed from a hollow and substantially continuous ornament 30, providing advantages in construction and use never before realized in the art. Once more, a variety of other such configurations and arrangements is possible according to aspects of the present invention without departing from its spirit and scope, as will be further appreciated from the alternative exemplary embodiments shown and described herein. Effectively, the shell or ornament body 30 of any ornament apparatus 20 according to aspects of the present invention could be a variety of different shapes and be partially or fully hollow.

Figure 3:
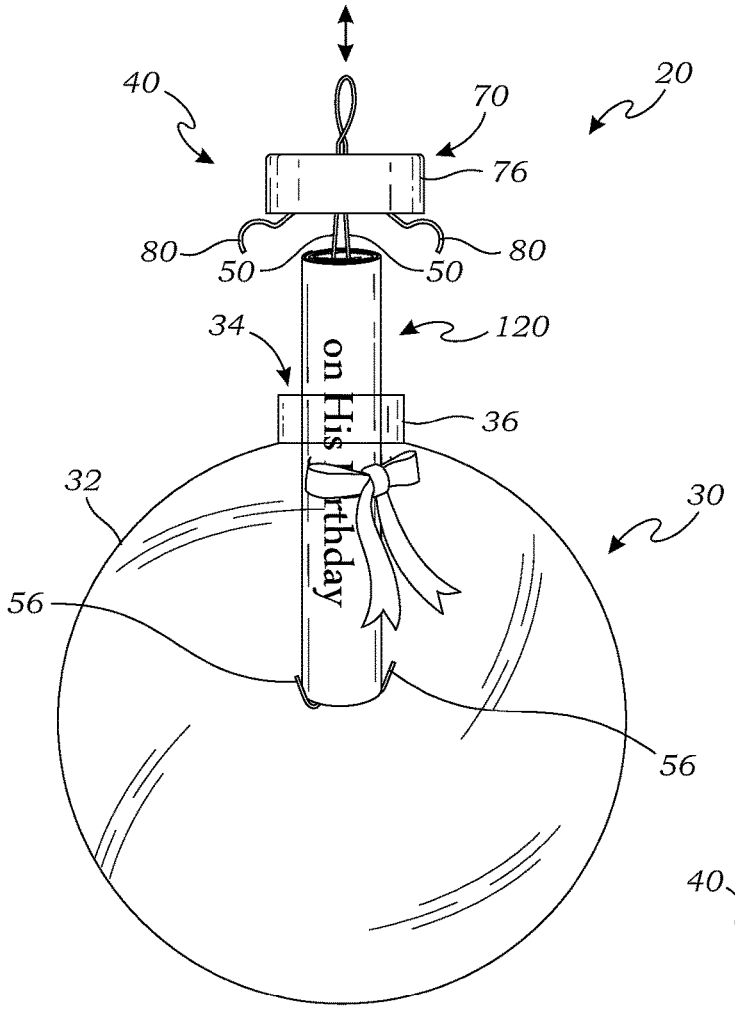
FIG. 3 is a further partially exploded side view thereof, in accordance with at least one embodiment.
Figure 4:
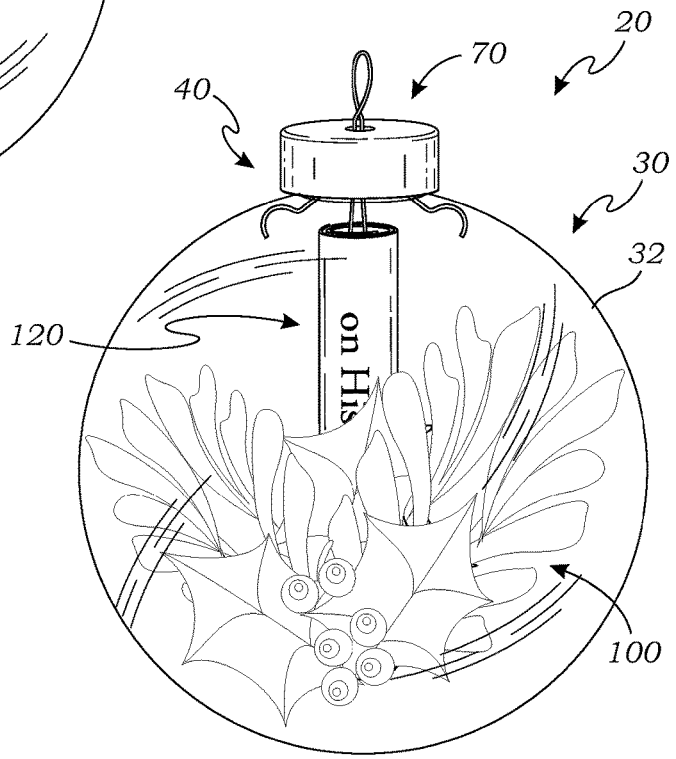
FIG. 4 is a perspective view of an alternative exemplary message ornament apparatus, in accordance with at least one embodiment.

Turning briefly to the perspective view of FIG. 4, there is shown an alternative exemplary embodiment of a message ornament apparatus 20 according to aspects of the present invention, here in all respects being the same as that of FIGS. 1-3 except that within the ornament body 30 there is further installed an ornament decoration 100 separate and independent of any message 120 or message holder 40. This is to simply illustrate that other decorations 100 may be included in the apparatus 20, whether inserted before or after the ornament body 30 is formed, which decorations 100 may remain in the ornament 30 and be unaffected by the insertion and removal of a message 120 via the message holder 40; that is, messages 120 may conveniently be inserted or replaced without having to remove or accidentally or inadvertently removing any such decorations 100. Those skilled in the art will appreciate that the illustrated holly leaf and berry and other such greenery decorations 100 are merely exemplary and non-limiting. It will be further appreciated that any such ornament decorations 100 may be loose or somehow affixed within the ornament body 30. By way of further illustration and not limitation, the ornament body 30 may contain sand, glitter, confetti, artificial snow, or other such "loose" or "floating" decorations. Where any such decorations 100 may be suspended in liquid (not shown), it will be appreciated that a central "dry" tube or channel (not shown) may be formed within the ornament body 30 in communication with the opening 34 in the body wall 32 for removable receipt of the message scroll 120 through the opening 34 without removal, leakage, or loss of the decorations 100, or while such liquid-based ornament decorations 100 remain sealed off. Once again, such ornament decorations 100, and whether holiday-themed or seasonal, character-themed, or otherwise, can take on a virtually infinite variety of appearances and configurations, and thus the particular message ornament apparatus 20 and the shell or body 30 and any cap 70 or other feature thereof, without departing from the spirit and scope of the invention.

Figure 5:
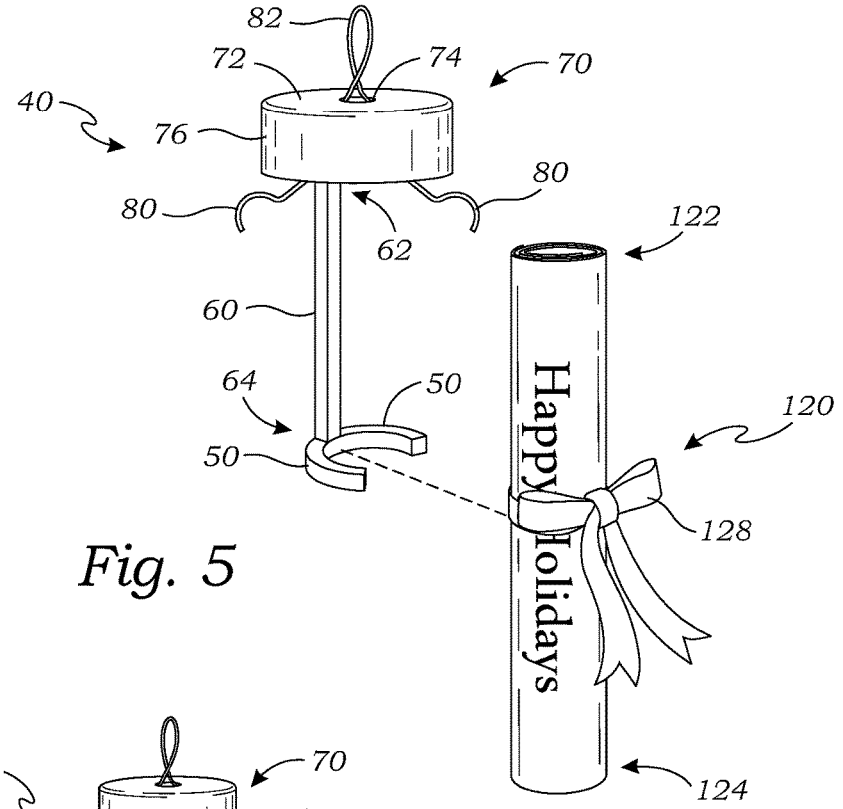
FIG. 5 is an enlarged exploded partial perspective view of a further alternative exemplary message ornament apparatus, in accordance with at least one embodiment.
Figure 6:
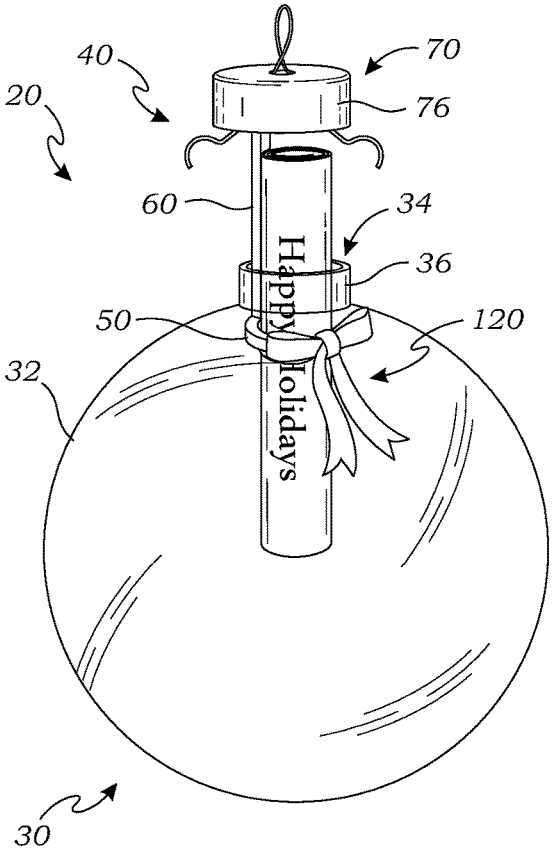
FIG. 6 is a further partially exploded perspective view thereof, in accordance with at least one embodiment.
Figure 7:
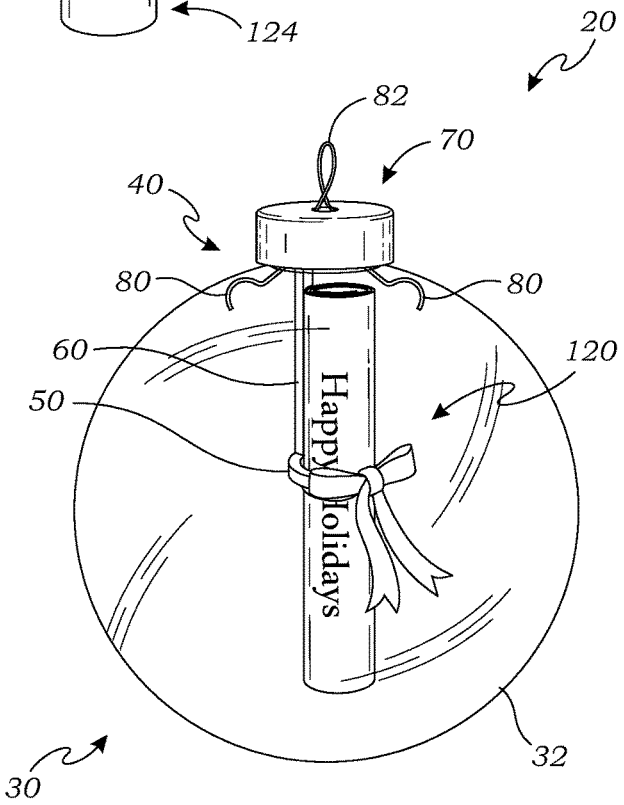
FIG. 7 is an assembled perspective view thereof, in accordance with at least one embodiment.

Referring next to FIGS. 5-7, there are shown partial exploded and assembled perspective views of a further alternative exemplary embodiment of a message ornament apparatus 20 according to aspects of the present invention, here particularly having an alternative configuration of the message holder 40. Thus, referring first to the enlarged partial exploded view of FIG. 5, it can be seen that the legs 50 of the holder 40 are configured to lie in a plane somewhat perpendicular to the axis of the message scroll 120 and are curved and offset in such a manner as to effectively form a clip for engaging the scroll 120 itself at an intermediate location between the opposite proximal and distal ends 122, 124 of the scroll 120, rather than the elongate legs 50 with tines 56 configured to pass axially through the core 126 of the scroll 120 as in the exemplary embodiments of FIGS. 1-4. Accordingly, the legs 50 are here supported or mounted as suspended distally a distance from the cap 70 on the distal end 64 of a substantially vertically arranged support member or strut 60, which is itself installed on or formed integrally with the cap 70 at its opposite proximal end 62. Those skilled in the art will appreciate that such components may again be formed of any appropriate material and by any appropriate means now known or later developed, the clip-like opposed legs 50 potentially having sufficient resiliency to flex apart as a living hinge so as to selectively accept a message scroll 120 or the like, though it will be further appreciated that even a relatively rigid clip or set of legs 50 may be employed, in which case the message 120 may itself be squeezed into the clip or the space between the legs 50 or may be slid axially into the clip or between the legs 50, in either and all cases the message scroll 120 being held in place essentially be friction. Again, the legs 50 and support strut 60 may be formed integrally or separately and then assembled, which is also true of the cap 70 relative to the legs 50 and strut 60; again, any manufacturing and/or assembly method now known or later developed may be employed in forming such message holder 40, with or without the cap 70, in whole or in part, including but not limited to molding, forming, stamping, machining, bonding, welding, fastening, and the like. In such alternative arrangement of the holder 40, it will be further appreciated that by effectively grasping or securing the message scroll 120 or the like from the side, with the strut 60 thus running along and parallel to the scroll 120, in order to substantially center the message scroll 120 beneath the cap 70 and thus within the opening 34 of the ornament 30 upon insertion or removal, it is thus necessary in the alternative embodiment to position the exemplary support strut 60 offset or off-center relative to the cap 70 as shown. Those skilled in the art will appreciate that other such arrangements of the strut 60 or other support structure for the legs 50 or other structure that selectively and temporarily engages the message scroll 120 may be employed according to aspects of the present invention without departing from its spirit and scope, such that the alternative exemplary embodiment of the holder 40 with strut 60 supporting the clip-like legs 50 is again to be understood as illustrative and non-limiting. Furthermore, as shown in FIGS. 5-7, opposed spring-wire arms 80 and related hanger or ring 82 may again be incorporated into the cap 70 in a manner as known in the art or of course may instead be uniquely integrated or incorporated with the cap 70 and/or holder 40 as herein disclosed. And once more, while such holder 40 is shown and described as effectively being integrated with the cap 70, such is not required but may instead be completely independent of the cap 70, as by seating the holder 40 directly in the opening 34 of the ornament 30 and then just placing the cap 70 separately thereover, for example. No decorations 100 (FIG. 4) are here shown as being inserted in the spherical ornament 30 for simplicity, though it will be appreciated that such may be included within the ornament 30 just as in other alternate embodiments. And once again, while a spherical ornament 30 is shown, the invention is not at all so limited, which it will be appreciated by those skilled in the art.

Figure 8:
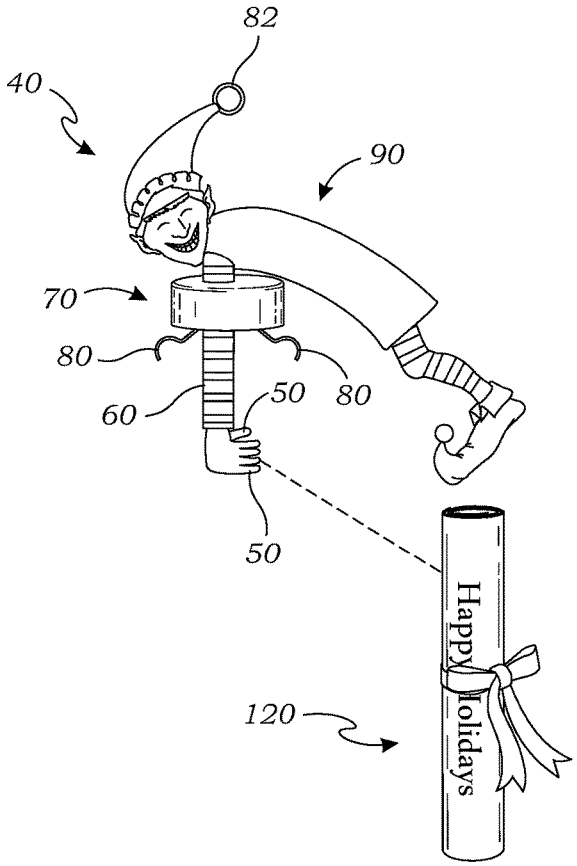
FIG. 8 is an exploded partial perspective view of a still further alternative exemplary message ornament apparatus, in accordance with at least one embodiment.
Figure 9:
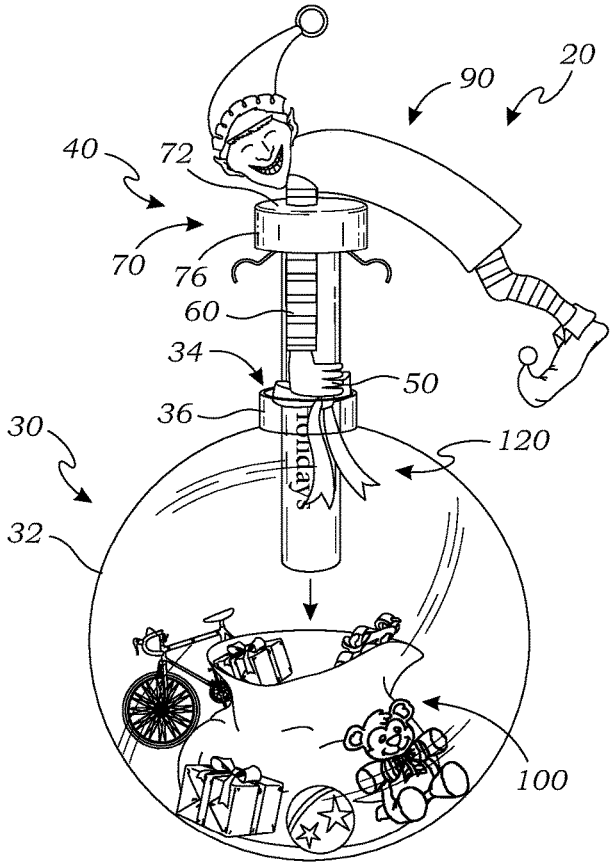
FIG. 9 is a further partially exploded perspective view thereof, in accordance with at least one embodiment.
Figure 10:
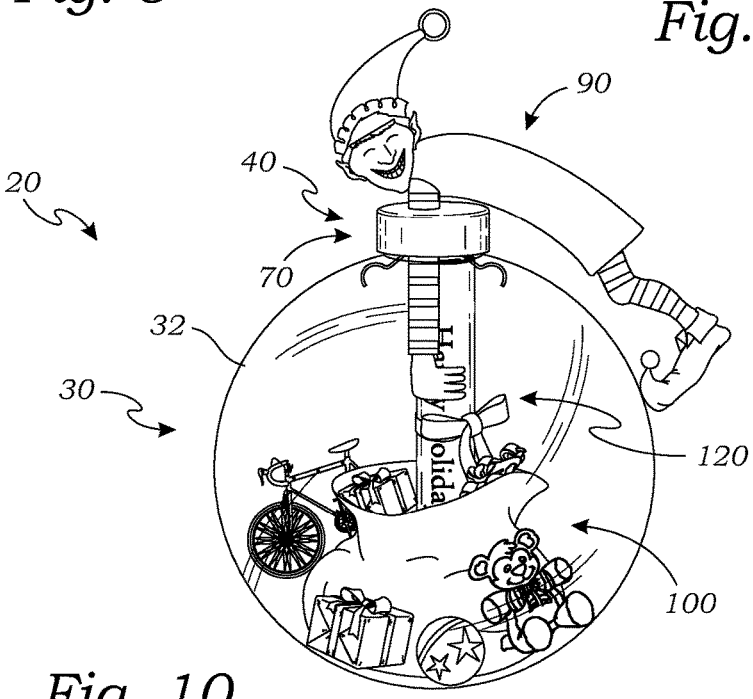
FIG. 10 is an assembled perspective view thereof, in accordance with at least one embodiment.

Referring next to FIGS. 8-10, there are shown partial exploded and assembled perspective views of a still further alternative exemplary embodiment of a message ornament apparatus 20 according to aspects of the present invention, somewhat analogous to the alternative embodiment of FIGS. 5-7, except here having the alternative message holder 40 configured decoratively. In more detail, it will be appreciated that the support structure of the holder 40, namely the strut 60 and the legs 50, may be "disguised" for both functional and aesthetic purposes in rendering the design of the product with other desirable features. As illustrated, the strut 60 may be formed, for example, so as to resemble a clothed anatomical arm and the legs 50 or clip may be formed at the end of such arm-like strut 60 so as to resemble an anatomical hand, with four fingers replacing one leg 50 and the thumb of the hand replacing the other, opposite leg 50 forming the clip. In use, it will be appreciated that securing the message scroll 120 within the message holder 40, and between the hand-like legs 50 specifically, will thus give the appearance that the scroll 120 is being gripped or held by someone or something having such anatomy. Accordingly, and more particularly, with continued reference to FIGS. 8-10, the arm-like strut 60 may be formed so as to resemble that of an elf or the like, with the rest of the body of the elf configured as a cap decoration 90 incorporated into the cap 70. As a result, those skilled in the art will appreciate that when assembled as shown in FIG. 10, the message ornament apparatus 20 will give the appearance that an elf is laying on the ornament 30 with his hand reaching through the top or opening 34 of the ornament 30 and holding the message scroll 120. Accordingly, with the elf-like cap decoration 90 so configured integrally with the cap 70, other functional aspects of the cap 70 may be further incorporated, such as still having a top 72 and a skirt 76 configured to seat on and about the neck 36 of the ornament 30, including the opposite spring-like wire arms 80 for selectively securing the cap 70 on the ornament 30, here such cap top 72 and skirt 76 effectively positioned about the strut 60 in the region appearing as the elf's upper arm, and further such as incorporating the ring 82 for selectively hanging the ornament apparatus 20 here into the elf's hat rather than the cap 70 more directly. Once again, those skilled in the art will appreciate that a wide variety of cap and other such decorations 90 may be included or incorporated within the functional features of the apparatus 20 beyond those shown and described without departing from the spirit and scope of the invention. Relatedly, decorations 100 may be placed within the ornament 30 to further the overall function and aesthetics of the apparatus 20. Specifically, as shown, there may configured within the ornament body 32 a bag of gifts as Santa's pack is sometimes depicted, here such decorative or miniature arrangement of gifts within the bag being configured with a central opening or void to accommodate the inserted message scroll 120. In that way, it will be appreciated that the overall apparatus 20 simulates or gives the appearance that the elf is inserting within or removing from the bag of gifts decoration 100 the message scroll 120. Once more, other such cap and ornament decorations 90, 100 and arrangements are possible according to aspects of the present invention without departing from its spirit and scope, such that that shown and described is to be understood as merely illustrative and non-limiting.

Figure 11:
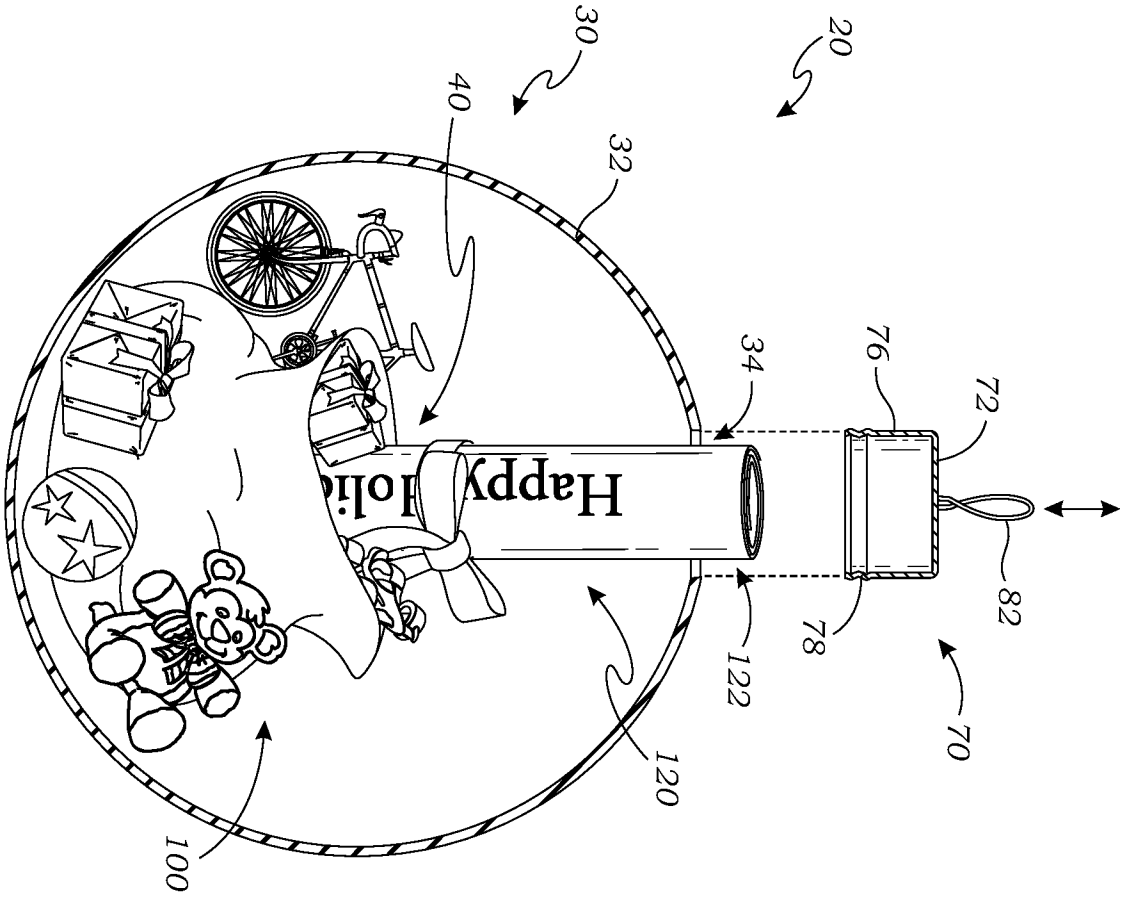
FIG. 11 is an enlarged partially exploded side view, partially in section, of a still further alternative exemplary message ornament apparatus, in accordance with at least one embodiment.

Finally, turning to FIG. 11, there is shown a partially-exploded side cross-sectional view of a still further alternative exemplary embodiment of a message ornament apparatus 20 according to aspects of the present invention, somewhat analogous to the alternative embodiment of FIGS. 8-10 in that there is again included an ornament decoration 100 within the ornament body 30, except that here the alternative message holder 40 is configured as such ornament decoration 100 rather than a cap decoration 90. That is, as shown, for purposes of illustration the ornament decoration 100 is again configured as a bag of gifts as Santa's pack is sometimes depicted, here again such decorative or miniature arrangement of gifts within the bag being configured with a central opening or void to accommodate the inserted message scroll 120. More particularly, in the further alternative exemplary embodiment of FIG. 11, such central opening within the ornament decoration 100 also serves as the message holder 40, there being no other provided structure to insert or remove the message scroll 120 as in other exemplary embodiments. Rather, the depth of the message holder 40 hole or feature within the ornament decoration 100 in cooperation with the length of the message scroll 120 from its proximal end 122 to distal end 124 (FIG. 2) is such that the proximal end 122 of the message scroll 120 extends beyond the ornament opening 34 as shown even when the message scroll 120 is fully inserted. It will be appreciated that in this manner the scroll 120 may be accessed for retrieval by simply grasping its exposed proximal end 122, without the need for any other holder 40 as disclosed in FIGS. 1-10 or other such feature for selectively accessing or grasping the message scroll 120. Moreover, with continued reference to FIG. 11, in order to selectively conceal the message, scroll 120 or cover its protruding proximal end 122 and thus complete the assembly of the ornament apparatus 20 for hanging or display during use, there is provided a cap 70 having a top wall 72 and a circumferential, distally-protruding skirt 76 formed with an outer circumferential groove or undercut 78 configured to snap or seat within the opening 34 of the ornament body 32. Effectively, the opening 34 is formed without a proximally-extending neck 36 (FIG. 2) such that the proximal end 122 of the message scroll 120 may be exposed when the cap 70 is removed, the cap skirt 76 doubling as the neck when assembled on the ornament body 32. To complete the cap 70 structure, the top 72 may be formed with a proximally-extending ring 82 or the like again for receipt of a hook, ribbon, string, twine, chain, etc. (not shown) when hanging the ornament apparatus 20. As with all such embodiments disclosed herein, it will be appreciated that while a spherical ornament body 32 is shown as having an annular opening 34 engaged by an annular cap 70, the invention is not so limited, but may instead take a number of other forms without departing from its spirit and scope. Further, in the particular alternative embodiment of FIG. 11, the illustrated configuration of the cap 70 with its undercut 78 for selectively and removably engaging the ornament body 32 is merely illustrative and non-limiting, with any such temporary securement means now known or later developed being potentially employed, including but not limited to, threads, press-fit, living hinge, flexing tabs, and the like. Once again, any of the features of the exemplary embodiments of the ornament apparatus 20 in a variety of combinations beyond those shown and described are possible according to aspects of the present invention, such that each of the exemplary embodiments are to be understood as illustrative and non-limiting.

Aspects of the present specification may also be described as follows:

1. A message ornament apparatus comprising: an at least partially transparent and at least partially hollow ornament body having a fixed opening; an ornament decoration disposed within the ornament body; a user-written message scroll configured for selective insertion within the ornament body through the opening; and a message holder configured for installation within the ornament body to facilitate selective securement or removal of the message scroll through the opening without removing the ornament decoration.

2. The apparatus of embodiment 1 wherein the ornament body is substantially continuous.

3. The apparatus of embodiment 1 or embodiment 2 wherein the ornament body is substantially spherical.

4. The apparatus of any of embodiments 1-3 wherein the ornament body is substantially hollow.

5. The apparatus of any of embodiments 1-4 further comprising a cap configured for selectively closing the opening.

6. The apparatus of embodiment 5 wherein the message holder is incorporated into the cap.

7. The apparatus of any of embodiments 1-6 wherein the message holder comprises opposed resilient legs.

8. The apparatus of embodiment 7 wherein the legs are substantially downwardly-projecting and outwardly-biased and assembled at proximal ends thereof with the cap.

9. The apparatus of embodiment 7 or embodiment 8 wherein the legs are formed at opposite distal ends thereof having radially outwardly-projecting tines.

10. The apparatus of embodiment 9 wherein the message scroll is formed having a core and the legs are formed so as to extend through the core from their proximal to distal ends such that the tines selectively hook beneath a distal end of the message scroll and thereby support and retain the message scroll on the message holder.

11. The apparatus of any of embodiments 7-10 wherein the legs are substantially vertically centered on the cap, whereby the message scroll may be substantially centered relative to the cap.

12. The apparatus of any of embodiments 7-11 wherein the cap further comprises downwardly-projecting and outwardly-biased arms configured to selectively contact a wall of the ornament body so as to retain the cap thereon.

13. The apparatus of embodiment 12 wherein the legs and arms are formed integrally.

14. The apparatus of any of embodiments 7-13 wherein the cap further comprises an upwardly-extending ring.

15. The apparatus of embodiment 14 wherein the legs and ring are formed integrally.

16. The apparatus of any of embodiments 7-15 wherein the legs are substantially horizontally-extending opposed legs configured for removable receipt therebetween of the message scroll intermediate proximal and distal ends thereof.

17. The apparatus of any of embodiments 7-16 wherein curvature of the legs substantially conforms to that of the message scroll.

18. The apparatus of any of embodiments 7-17 wherein the message holder further comprises a substantially vertically-extending strut assembled with the cap at a proximal end thereof and supporting the legs at a distal end thereof.

19. The apparatus of embodiment 18 wherein the strut is positioned vertically offset on the cap, whereby the message scroll may be substantially centered relative to the cap.

20. The apparatus of embodiment 18 or embodiment 19 wherein a cap decoration is incorporated into one or more of the cap, the strut, and the legs.

21. The apparatus of any of embodiments 5-20 wherein the cap further comprises a top and a perimeter skirt configured to enclose the opening.

22. The apparatus of embodiment 21 wherein the skirt is configured to seat over an outwardly-protruding neck formed on the ornament body about the opening.

23. The apparatus of embodiment 21 or embodiment 22 wherein the skirt is formed with an outwardly-opening circumferential undercut configured to seat within the opening.

24. The apparatus of any of embodiments 5-23 wherein the cap further comprises a hole for the passage therethrough of a ring.

25. The apparatus of any of embodiments 5-24 wherein the cap further comprises a cap decoration.

26. The apparatus of any of embodiments 5-25 wherein upon insertion of the message holder containing the message scroll within the ornament body through the opening and placement of the cap over the opening the message scroll is completely housed within the ornament body.

27. The apparatus of any of embodiments 1-26 wherein the message holder is installed within the ornament body.

28. The apparatus of any of embodiments 1-27 wherein the message holder is incorporated into the ornament body.

29. The apparatus of any of embodiments 1-27 wherein the message holder is incorporated into the ornament decoration.

30. The apparatus of any of embodiments 1-29 wherein the message scroll is removably receivable within the message holder.

31. The apparatus of embodiment 30 wherein the message scroll as received within the message holder protrudes at a proximal end out of the opening beyond the ornament body.

32. The apparatus of any of embodiments 1-31 wherein the message scroll is substantially tubular.

33. The apparatus of any of embodiments 1-32 wherein the message scroll is bound with a ribbon.

34. A method of employing a message ornament apparatus as defined in any one of embodiments 1-33, the method comprising the steps of: selectively placing the message scroll within the message holder adjacent to an ornament decoration within the ornament body; and selectively removing the message scroll from the ornament body through the opening without removing the ornament decoration.

35. The method of embodiment 34, wherein the step of selectively placing the message scroll comprises seating the message scroll over lengthwise legs of the message holder so as to engage the distal end of the message holder with the distal tines formed on the legs.

36. The method of embodiment 35, wherein the step of seating the message scroll over lengthwise legs further comprises squeezing the distal ends of the lengthwise legs together so as to allow their passage into the core of the message scroll.

37. The method of embodiment 34, wherein the step of selectively placing the message scroll comprises clipping the message scroll within opposed legs of the message holder.

38. The method of embodiment 34, wherein the step of selectively placing the message scroll comprises lowering the message scroll through the opening until the distal end thereof seats within the message holder formed within the ornament body.

39. The method of any of embodiments 34-38, wherein the step of selectively removing the message scroll comprises lifting a cap having incorporated therein the message holder off of the opening of the ornament body and further shifting the cap and message holder away from the ornament body so as to extract the message holder and message scroll therefrom.

40. The method of any of embodiments 34-38, wherein the step of selectively removing the message scroll comprises lifting a cap off of the opening of the ornament body so as to expose the proximal end of the message scroll, grasping the exposed proximal end of the message scroll, and shifting the message scroll away from the ornament body so as to extract the message scroll from the message holder and the ornament body.

41. The method of any of embodiments 34-40, further comprising the step of writing a personalized message on the message scroll.

42. The method of any of embodiments 34-41, further comprising the step of rolling the message scroll into a substantially tubular configuration.

43. The method of any of embodiments 34-42, further comprising the step of binding the message scroll with a ribbon.

44. The method of any of embodiments 34-43, further comprising the step of displaying the message ornament apparatus with the personalized message scroll therein.

45. A kit comprising a message scroll apparatus as defined in any one of embodiments 1-33.

46. The kit of embodiment 45, further comprising a plurality of message scrolls for alternating use within the message ornament apparatus.

47. The kit of embodiment 45 or embodiment 46, further comprising instructional material.

48. The kit of embodiment 47, wherein the instructional material provides instructions on how to perform the method as defined in any one of embodiments 34-44.

49. Use of a message ornament apparatus as defined in any one of embodiments 1-33 to customize the display of at least a personalized message scroll within an ornament.

50. The use of embodiment 49, wherein the use comprises a method as defined in any one of embodiments 34-44.

In closing, regarding the exemplary embodiments of the present invention as shown and described herein, it will be appreciated that a message ornament apparatus is disclosed and configured for conveniently allowing the insertion and removal of personalized messages and mementos through the opening without unwanted removal of other decorations. Because the principles of the invention may be practiced in a number of configurations beyond those shown and described, it is to be understood that the invention is not in any way limited by the exemplary embodiments, but is generally directed to a message ornament apparatus for customizing the display of at least a personalized message scroll within an ornament and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

In some embodiments, the numbers expressing quantities of ingredients, properties such as concentration, reaction conditions, and so forth, used to describe and claim certain embodiments of the inventive subject matter are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the inventive subject matter are approximations, the numerical values set forth in the specific examples are reported as precisely as practicable. The numerical values presented in some embodiments of the inventive subject matter may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. The recitation of numerical ranges of values herein is merely intended to serve as a shorthand method of referring individually to each separate value falling within the range. Unless otherwise indicated herein, each individual value of a numerical range is incorporated into the specification as if it were individually recited herein. Similarly, all lists of values should be considered as inclusive of intermediate values unless the context indicates the contrary.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the inventive subject matter and does not pose a limitation on the scope of the inventive subject matter otherwise claimed. No language in the application should be construed as indicating any non-claimed element essential to the practice of the invention.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C and N, the text should be interpreted as requiring only one element from the group, not A plus N, or B plus N, etc.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor (s) believe that the claimed subject matter is the invention.

What is claimed is:

1. A message ornament apparatus comprising:

an at least partially transparent and at least partially hollow ornament body having a fixed opening;

a cap configured for selectively closing the opening;

a user-written message scroll configured for selective insertion within the ornament body through the opening; and a message holder configured for installation within the ornament body to facilitate selective securement or removal of the message scroll through the opening;

wherein the message holder is incorporated into the cap and comprises opposed, outwardly-biased, resilient legs extending substantially downwardly from the cap;

wherein each leg includes a proximal end located proximal to the cap and a distal end located distally from the cap, and the distal ends each include a tine projecting radially outwardly from the legs;

wherein the message scroll includes a proximal end, a distal end, and a hollow core; and wherein the legs extend through the hollow core of the message scroll from its proximal end to its distal end such that the tines selectively hook beneath the message scroll's distal end, thereby supporting and retaining the message scroll.

2. The apparatus of claim 1 wherein the cap further comprises an upwardly-extending ring.

3. The apparatus of claim 1 wherein the cap further comprises a top and a perimeter skirt configured to enclose the opening.

4. The apparatus of claim 3 wherein the skirt is configured to seat over an outwardly-protruding neck formed on the ornament body about the opening.

5. The apparatus of claim 3 wherein the skirt is formed with an outwardly-opening circumferential undercut configured to seat within the opening.

6. The apparatus of claim 1 wherein the cap further comprises a cap decoration.

7. The apparatus of claim 1 wherein the message holder is installed within the ornament body.

8. The apparatus of claim 1, wherein the message holder is configured for installation within the ornament body to facilitate selective securement or removal of the message scroll through the opening without removing an ornament decoration within the ornament body.

9. The apparatus of claim 1 wherein the message scroll is removably receivable within the message holder and the message scroll as received within the message holder protrudes at a proximal end out of the opening beyond the ornament body.

10. A message ornament apparatus for selectively displaying a user-written message scroll, the apparatus comprising:

an at least partially transparent and at least partially hollow ornament body having a fixed opening;

an ornament decoration disposed within the ornament body;

a cap configured for selectively closing the opening; and a message holder incorporated into the cap and configured for installation within the ornament body so as to facilitate selective securement or removal of the message scroll through the opening without removing the ornament decoration;

wherein the message holder comprises opposed, outwardly-biased, resilient legs extending substantially downwardly from the cap;

wherein each leg includes a proximal end located proximal to the cap and a distal end located distally from the cap, and the distal ends each include a tine projecting radially outwardly from the legs;

wherein the message scroll includes a proximal end, a distal end, and a hollow core; and wherein the legs extend through the hollow core of the message scroll from its proximal end to its distal end such that the tines selectively hook beneath the message scroll's distal end, thereby supporting and retaining the message scroll.

11. The apparatus of claim 8, wherein the message holder is configured for installation within the ornament body to facilitate selective securement or removal of the message scroll through the opening without removing the ornament decoration.

12. The apparatus of claim 8 wherein the message holder is incorporated into the ornament decoration.

13. An assembled message ornament apparatus comprising:

an at least partially transparent and at least partially hollow ornament body having a fixed opening;

a cap selectively closing the opening;

an ornament decoration disposed within the ornament body;

a message scroll inserted into the ornament body through the opening; and a message holder installed within the ornament body that facilitates selective securement or removal of the message scroll through the opening without removing the ornament decoration;

wherein the message holder is incorporated into the cap and comprises opposed, outwardly-biased, resilient legs extending substantially downwardly from the cap:

wherein each leg includes a proximal end located proximal to the cap and a distal end located distally from the cap, and the distal ends each include a tine projecting radially outwardly from the legs;

wherein the message scroll includes a proximal end, a distal end, and a hollow core; and wherein the legs extend through the hollow core of the message scroll from its proximal end to its distal end such that the tines selectively hook beneath the message scroll's distal end, thereby supporting and retaining the message scroll.

* * * * *